United States Patent [19]

Button et al.

[11] 4,199,433

[45] Apr. 22, 1980

[54] SOLVENT DEHYDRATION SYSTEM

[75] Inventors: Harold O. Button, Cape May, N.J.; Thomas F. McCall, Fairway; Donald W. Meyer, Overland Park, both of Kans.

[73] Assignee: The C. W. Nofsinger Company, Kansas City, Mo.

[21] Appl. No.: 9,538

[22] Filed: Feb. 5, 1979

[51] Int. Cl.[2] ..... C10G 43/08

[52] U.S. Cl. ..... 208/31; 208/33; 208/321

[58] Field of Search ..... 208/31, 33, 321

[56] References Cited

U.S. PATENT DOCUMENTS

| | | | |
|---|---|---|---|
| 2,463,845 | 3/1949 | Backlund et al. | 208/33 |
| 3,130,143 | 4/1964 | Salmon et al. | 208/33 |
| 3,867,112 | 2/1975 | Honerkamp et al. | 55/32 |
| 4,052,294 | 10/1977 | Blume et al. | 208/33 |

*Primary Examiner*—Herbert Levine

*Attorney, Agent, or Firm*—Thomas M. Scofield

[57] ABSTRACT

Improvements in processes for stripping solvent from dewaxed oils and deoiled waxes; the use of an inert gas (such as nitrogen) as a stripping agent for removing solvent from dewaxed oils, deoiled waxes and slack waxes resultant from solvent dewaxing processes.

14 Claims, 2 Drawing Figures

SOLVENT DEHYDRATION SYSTEM

BACKGROUND OF THE INVENTION

Figure 1:
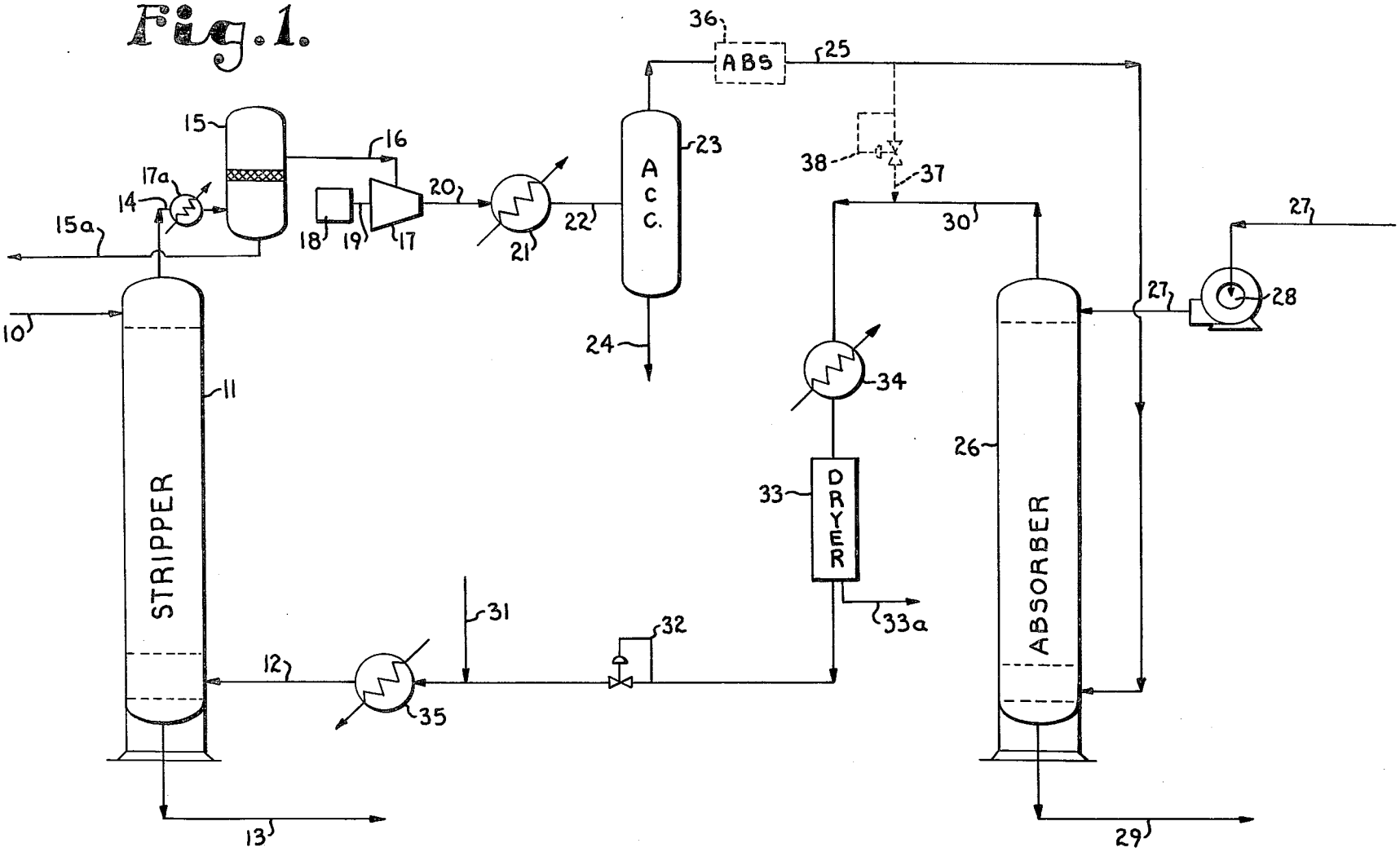

In plants for the production of lubricating oils, solvent dewaxing is employed to remove wax from the lubricating oil stocks. In such processes either distillate or residual stocks of practically any viscosity in the raw or refined state from any crude source can be dewaxed. These remarks also apply to the production of deoiled waxes or wax free of oil.

In the basic process, to which this improvement is an adjunct only, to remove wax from the lubricating oil stock, a dilution solvent is introduced into a wax bearing oil stream. The solvent employed generally consists of a mixture of methyl ethyl ketone and an aromatic solvent (benzol, toluol or a mixture of the two). Dilution solvent dosages vary from a solvent-to-oil ratio of 1.0:1 to about 10.0:1 depending on the nature and viscosity of the charge stock. Other ketones, such as methyl isobutyl ketone and other aromatics may be used.

In the dewaxing process, which is well known in the art (Petroleum Refiner, Volume 15, Number 6, June 1936, pages 205–209, inclusive and September, 1974 Hydrocarbon Processing at page 188) such typically produces, as result thereof, three streams: (1) a dewaxed oil with solvent, (2) oil free wax with solvent and (3) slack wax with solvent. Currently, these products from the solvent dewaxing process have the solvent removed therefrom in steam strippers in order that the solvent may be recycled to the dewaxing process. The recovered solvent must then be separated from the water before the solvent can be recycled to the dewaxing process. In such procedure, the water content of the solvent is a critical design parameter. Also see Petroleum Processing Handbook, W. F. Bland and R. L. Davidson, McGraw-Hill 1967 Pages 3–92 through 3–94.

In typical operation of a solvent dewaxing process, the dilution solvent is introduced into a wax-bearing oil stream in controlled amounts at selected points in the chilling cycle so as to insure a wax crystal structure and liquid viscosity most suitable for filtration. The chilled charged mixture of solvent and wax-bearing oil stream flows through a filter feed tank typically to enclosed drum-type rotary vacuum filters. In these filters compartmentalized, cloth covered drums rotate, partially submerged in enclosed filter cases. A wax-free oil filtrate solution is drawn through the filter cloth to filtrate tanks in which the vacuum, which induces filtration, is maintained. The wax cake deposited upon the drum during filtration is washed on the filter continuously and automatically with cold solvent to produce a low oil content wax product.

The filtrate from the filtrate receiver is pumped through the heat exchangers to evaporators for recovery of the solvent heat for evaporating the solvent from the dewaxed oil solution.

In this prior art process, where at least two streams (relatively oil free wax plus solvent and relatively wax free oil plus solvent) are steam stripped to remove the solvent from the respective streams, a major problem exists with respect to separating the stripped solvent from the water resulting from the use of stripping steam. One manner of accomplishing this is to incorporate a solvent fractionator in the system. It is a difficult problem to maintain a proper and minimum water level in the solvent recycled into the dewaxing process. Water is at least to some extent soluble in the solvent and the solvent cannot be entirely separated from the water because the mixture will form an azeotropic mixture.

BRIEF DESCRIPTION OF THE INVENTION

In the instant process, the product streams from the dewaxer (oil free wax plus solvent, wax free oil plus solvent and slack wax plus solvent), any one, several or all of them, preferably the latter, are solvent stripped with clean, solvent free nitrogen. The product from the stripping vessel, in each case, then, would be solvent free wax free oil, solvent free oil free wax or solvent free slack wax. The solvent in each product would be reduced to an extremely low level, in the range of three parts per million. Other inert gases may be used.

The solvent rich stripping gas, after compression and condensation, is passed to an accumulator where the greater portion of the solvent and any carry-over oil or wax is removed. However, the stripping gas (preferably nitrogen) at this point is still not acceptable for recycle use to the basic stripper of the subject product. Therefore, at this point the stripping gas, nitrogen, with its residual load of solvent, is passed to an absorber vessel where it is contacted with the charge oil stock to the solvent dewaxing process itself. In this absorption step, then, the residual solvent is removed from the inert stripping gas and the latter can be employed in the basic stripping vessel again, in recycle. The charge stock, by this step, is also dehydrated to a greater or lesser degree.

OBJECTS OF THE INVENTION

A basic object of the invention is to eliminate steam stripping of products (wax free oil plus solvent, oil free wax plus solvent and slack wax plus solvent) in solvent dewaxing units in lube oil plants, thereby eliminating stripping steam as a source of water therein which is detrimental to its performance.

Another object of the invention is to provide a solvent stripping process for a solvent dewaxing unit in a lube oil plant wherein:

(1) The water content of the wet solvent is markedly reduced, thus achieving a marked reduction of ice formed in the process, thus saving in both refrigeration and heat;

(2) The wax cake in the dewaxing process becomes essentially ice free, thus permitting a reduction in solvent dosage because of this reduction in solids, this resulting in a substantial annual utility saving;

(3) The filter feed temperature to the vacuum filter can be increased substantially (in the order of five degrees F.) yet the dewaxed oil pour point specification can still be met because the solvent concentration in the dewaxing solvent mix can be increased without encountering oil phase separation, this resulting in refrigeration saving;

(4) Solvent losses can also be reduced (the major conventional solvent loss is in water sent to the refinery drain system from the bottom of the solvent/water fractionator), the savings in reduced solvent loss being substantial;

(5) By reducing water content in the wet solvent, oil phase separation in the feed to the dewaxing filter of the solvent dewaxing process is eliminated, substantially reducing the oil content of the slack wax. Reducing the amount of wax cake (as with ice) allows a reduction in solvent dosage, saving utility costs with an increase in the yield of the dewaxed oil.

Another object of the invention is to provide such a solvent recovery process utilizing inert gas in the place of stream stripping wherein, in addition to the above listed benefits, the capacity of the dewaxing unit is increased. Thus, solvent circulation rates and refrigeration loads are reduced, leaving excess capacity. Reduction of ice in the wax cake and the improved wax crystal structure, due to increased ketone concentration in the solvent, allow higher filtration rates.

Objects of the invention to be expected from the installation, in a solvent dewaxing process for the removal of wax from lubricating oil stocks and for the removal of oil from wax stocks, of the subject solvent dehydration process and apparatus include:

(1) The elimination of steam stripping of products from the solvent dewaxing process;

(2) Improved control of wax crystallization within the solvent dewaxing process;

(3) Minimizing or avoiding oil phase separation from the wax in the dewaxing process;

(4) A decrease in the temperature differential between the filter feed and the pour point of the dewaxed oil in the process;

(5) A lowering of the oil content of the wax product from the solvent dewaxing process;

(6) A considerable reduction in utility consumption per unit of charge to the solvent dewaxing unit;

(7) Considerable reduction of equipment corrosion in the solvent dewaxing process by virtue of removal of water from the system resulting in reduced maintenance requirements; and (8) Substantial or entire elimination of ice in the double pipe heat exchangers and in the wax cake in the dewaxing process;

(9) In summary, the overall benefit in most plants would be an increase in capacity of about ten percent.

Other and further objects of the invention will appear in the course of the following description thereof.

In the drawings, which form a part of the instant specification and are to be read in conjunction therewith, embodiments of the invention are shown.

FIG. 1 comprises a schematic flow diagram of an inert gas solvent stripping system applied to a product line from a solvent dewaxing unit for the removal of wax from lubricating oil stocks.

THE SUBJECT PROCESS

Referring to the drawing, the input line to the improved solvent stripping and recycle system is designated 10 and may feed as a charge stock any one of the typical products of a solvent dewaxing system. These are, typically: (1) substantially wax free oil containing solvent, (2) substantially oil free wax containing solvent and (3) slack wax containing solvent. The solvent employed generally consists of a mixture of a ketone such as MEK and an aromatic solvent (benzol, toluol or a mixture of the two). In the specific system in question, it is assumed that 79,291 pounds per hour of heavy oil (substantially wax free oil) and 3,978 pounds per hour of solvent are fed into the system through line 10. The feed through line 10 is into conventional vertical stripping vessel 11. An inert gas, preferably nitrogen, but optionally helium, argon, flue gas (nitrogen plus carbon dioxide) or methane is introduced into the bottom of stripper 11 through line 12. In the particular system involved, this flow constitutes 1,724 pounds per hour. Bottoms from stripper 11, comprising the solvent stripped product, are taken off through line 13 and passed out of the system. The temperature of the input in line 10 is typically 390° F., with the temperature of the discharge through line 13 about 373° F. The solvent stripped product departs the system in a volume of 77,182 pounds per hour with three parts per million or less of solvent therein.

A typical solvent mixture is methyl ethyl ketone and toluol in the composition of 60–40 percent by weight. A range of 90/10 through 30/70 MEK-Toluol would be satisfactory.

The overhead from stripper 11 is taken off through line 14 and passed to optional knockout drum 15. The overhead stream is solvent rich inert gas, made up of 1,724 pounds per hour inert gas (nitrogen), 3,978 pounds per hour of solvent and 109 pounds per hour of oil. The temperature is typically 377° F. and pressure 0.3 PSIG. Recycle of oil bottoms from drum 15 is through line **15*a* back to the dewaxer charge line 50 (FIG. 2) or, in some cases input line 10**. Any oil present is usually due to a poor charge stock or badly designed equipment in the dewaxing unit.

From drum 15 (or directly), the solvent rich gas passes through line 16 to compressor 17 driven by motor 18 through shaft 19. The compressor discharge, at 30 pounds PSIG, typically, is passed through line 20 to condenser 21. From condenser 21, line 22 passes to accumulator 23. In order to reduce compressor horsepower requirements cooler **17*a* may be provided before compressor 17**.

Bottoms from accumulator 23 are taken off through line 24 and comprise, typically, 3,622 pounds per hour of solvent and 109 pounds per hour of oil. The overhead from accumulator 23, typically comprising 1,724 pounds per hour of nitrogen and 356 pounds per hour of solvent, is at a temperature of approximately 100° F., passing to the lower portion of absorber tower 26 through line 25. It is necessary to remove the residual solvent from the stripping gas, before such can effectively be used in stripping tower 11.

Accordingly, through line 27, driven by pump 28, there is provided a stream of the charge stock wax-bearing oil stream, which is the input feed to the solvent dewaxing system which has produced the primary product stream (after the operation of the dewaxing process) in line 10. In the particular system shown, this feed to the top of absorber tower 26 through line 27 is at 150° F. and in the amount of 100,000 pounds per hour. The noted feed in line 27 is greatly in excess of that required for the task stated and thus its dehydration is less complete than desired or feasible. All or any part of the charge stock may be employed, but a suffficient quantity to accomplish the purpose stated must be used.

Bottoms from absorber tower 26 are taken off through line 29 at approximately 151° F. and comprise 100,000 pounds per hour of the charge stock wax-bearing solvent dewaxing process feed stream oil plus 356 pounds per hour of solvent. Overhead from absorber 26, taken off through line 30, comprises the inert gas, solvent free, typically pure nitrogen, at a temperature of 151° F. and in an amount of 1,724 pounds per hour. Make up solvent free inert gas or nitrogen may be provided in line 30 (also line 12) at 31 in the amount required to maintain a constant quantity of the stripping gas in the system. Back pressure, in the range of 10 to 25 PSIG is maintained on the system by valve 32 on line 30-12.

In order to insure that any water in the noted system is removed and ice loads and solubility problems minimized, a dryer package unit (such as a dessicant dryer employing silica gel) may be inserted at 33 with cooler or condenser 34 therebefore in line 30. Water is taken off through line 33*a*. Heater 35 may be provided in line 12 before stripped.

Thus there has been provided a solvent stripping process utilizing an inert gas, preferably nitrogen, to remove the solvent from the heavy wax free oil, the oil free wax or the slack wax effluent from a solvent dewaxing process applied to lubricating oil stocks. The bulk of the solvent is removed by compression and condensation of the solvent rich extracting gas at accumulator 23. However, in order to provide a solvent free stripping gas for stripper tower 11 which will produce an effectively solvent stripped product in line 13, it is necessary to remove the residual solvent from the stripping gas in an absorber 26. The charge stock to the solvent dewaxing process provides an admirable medium therefor with the bottoms from absorber 26 being immediately chargeable to the start or input to the solvent dewaxing process where the charge stock wax-bearing oil stream is typically mixed with solvent in a solvent to oil ratio of 1:1 to about 10:1, depending on the nature and viscosity of the charge stock. Clearly the amount of solvent picked up by the charge stock stream input through line 27 into absorber 26 is only a small fraction of this necessary dilution solvent dosage.

As an alternative to the use of the absorber tower 26 to remove the residual portion or quantity of solvent in the inert stripping gas, a solvent absorption bed 36 may receive the contents of overhead line 25 from accumulator 23. In the case of use of such bed, the solvent free inert gas is returned to line 12 by line 37. The equivalent of back pressure valve 32 is, in such case, shown at 38.

Yet alternatively, with the use of a greater pressure at compressor 17, or more cooling at condenser 21 (yet more preferably, both greater pressure and more cooling), one can cause the solvent to be substantially entirely separated in accumulator 23. This is an alternative to the process. At the very least, the increase of pressure and/or cooling in compressor 17 and condenser 21 would markedly decrease the load on the absorber bed 36 or in the absorber tower 26.

FIG. 2

Figure 2:
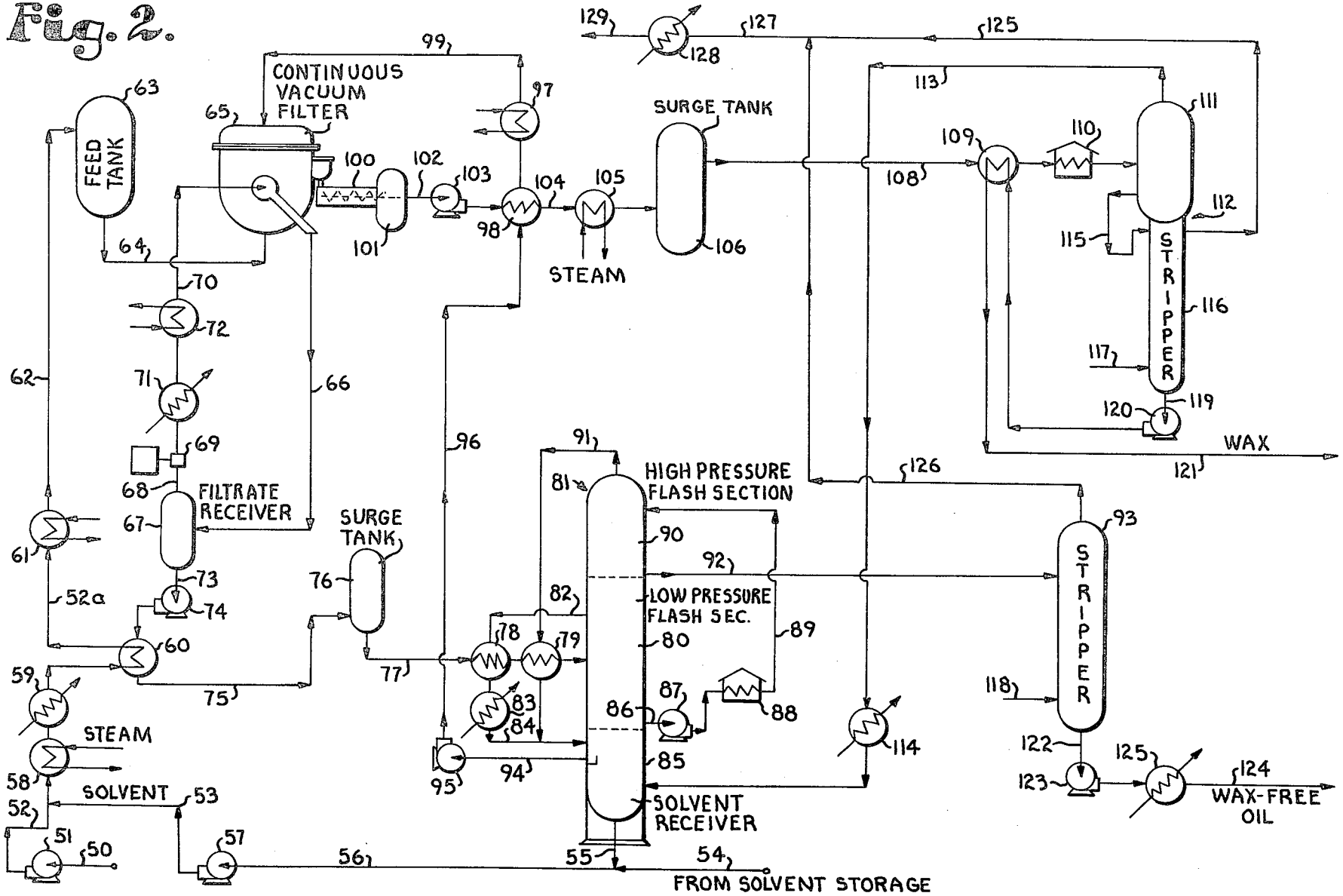

The flow diagram of FIG. 2 shows a schematic representation of a plant for removing wax from lubricating oil stocks, as well as producing deoiled waxes or wax free oil. This representation is based on the schematic flow diagram of a solvent dewaxing process seen in the September, 1974 Hydrocarbon Processing periodical at page 188, as well as the Petroleum Processing Handbook, Bland et al, McGraw Hill, 1967, pages 3–92 through 3–94 and, further, with respect to waxes, pages 3–97 and 3–98.

This process may employ a single or mixed solvent, excepting hydrocarbon solvents having less than five carbon atoms. Mixtures of methyl ethyl ketone (MEK) and toluol are most common. Other ketones may be used, either alone or mixed with an aromatic solvent. Such additional ketones include methyl isobutyl ketone and methyl n-butyl ketone. The composition of the solvent mixture depends largely upon the type of stock being dewaxed. Thus, more paraffinic stocks are dewaxed with a solvent containing less ketone than is generally used for dewaxing naphthenic or asphaltic stocks. Using solvent mixtures, proper proportioning of two opposing solvent actions permits control of wax solubility. Thus, both oil and wax are relatively insoluble in one solvent (MEK), while both oil and wax are soluble in all proportions in the other solvents (Benzol and toluol).

Typically, the solvent and charge oil are mixed with a solvent-oil ratio varying between 1.0 to 1.0 and 10.0 to 1.0, depending on the nature and viscosity of the charge. The mixture is then chilled through heat exchange and outside refrigeration to a temperature a few degrees below the desired pour point of the dewaxed oil, for example, −12° F. for cylinder stock charge. Low pressures are employed throughout the process.

The chilled oil and precipitated wax are then filtered, normally using a continuous rotary vacuum filter. Wash solvent is used on the wax filter cake before it is removed. The solvent-oil mixture is sent to the solvent recovery system for separation typically in a multiple effect evaporating unit. The solvent is removed from the wax slurry mix typically in a single effect evaporating unit.

Turning, then to FIG. 2, at 50, the charge stock is introduced, comprising, typically, either distillate or residual stocks of practically any viscosity, which may be in raw or refined state from any crude source. Pump 51 drives this stock into line 52, into which is fed make up and recycle solvent from line 53. Input make up solvent is provided in line 54, joining recycle line 55 from the solvent receiver to be described. These lines meet in line 56 having pump 57 thereon which discharges into line 53. In point of fact, in operation, the dilution solvent is introduced into the wax bearing oil stream in regulated amounts at selected points in the chilling cycle so as to insure a wax crystal structure and liquid viscosity most suitable for filtration. This multiple point input of solvent is not shown in FIG. 2, the line 53 input being a typical first such input.

Heater 58 is provided to put all components into solution and, thereafter, at cooler 59 and heat exchanger 60, as well as refrigerator 61, the chilling is undertaken. The chilled mixture, then, in line 62, passes to filter feed tank 63. The flow line through the cooling and chilling stages prior to line 62 is indicated in lines 52*a*.

From the filter feed tank 63, via line 64, the chilled charge mixture is passed into a continuous vacuum filter generally designated 65, having enclosed drum-type vacuum filters. Therein, compartmentalized, cloth covered drums are partially submerged in enclosed filter cases, rotating therein. A relatively wax-free oil filtrate solution is drawn through the filter cloth drums (not seen), being removed from vessel 65 through line 66 (with inert gas) passing to filtrate receiver 67.

Overhead recycle from receiver 67 is through line 68 to vacuum pump 69. The gas recycle line 70 has cooler 71 and refrigerator 72 thereon. In the filtrate tanks, at 67, the vacuum, which induced filtration in vessel 65, is maintained. Bottoms from receiver 67 are passed through line 73, driven by pump 74, and thereafter, via line 75, passing to surge tank 76. On the way, the filtrate from filtrate receiver 67 is pumped through double pipe heat exchangers, as at 60, for recovery of the solvent heat.

From surge tank 76, the oil filtrate solution is passed via line 77 through condenser/vaporizers 78 and 79 to the low pressure flash section 80 of vessel 81. From low pressure flash section 80, solvent vapors are taken through line 82 and through condenser/vaporizer 78 to cooler 83 and thence, via line 84, to the solvent receiver portion 85 of vessel 81. The oil comes out of section 80 through line 86, driven by pump 87, with heating at furnace 88. Thence, via line 89, the oil, with some solvent, goes to high pressure flash section 90 of vessel 81.

In high pressure flash section 90, solvent vapors are evaporated from the oil, with overhead line 91 taking off solvent vapors and passing same, through condenser/vaporizer 79, to join line 84 going into solvent receiver portion 85 of vessel 81. Relatively solvent free oil is passed via line 92 to a stripper 93 which is the same, processwise, as stripper 11 in FIG. 1.

In solvent receiver 85 of vessel 81, some solvent is taken back via line 94, driven by pump 95, thence via line 96 and, after refrigeration at 97 and prior cooling from the wax charge from filter 65 at 98, ultimately through line 99 back to filter 65.

In filter 65, the wax cake deposited on the compartmentalized, cloth covered rotating drums is continuously washed on the filter, automatically, with cold solvent, in order to produce a relatively low oil content wax product. The wax discharge from vessel 65 is through wax conduit 100 to drum 101, where it is melted. Thence, from drum 101, through line 102, driven by pump 103, the wax cools the solvent in exchanger 98 and thence, via line 104, is passed through heater 105 to surge tank 106. Tank 106 contains wax (relatively oil free) plus solvent. The relatively oil free wax and solvent is passed via line 108 through a heating step at 109 and furnace 110 to the wax mix flash section 111 of vessel 112. Heating at 110 and 88 may alternately be by high pressure steam heat exchanger.

The overhead from wax mix flash section 111 is passed through line 113 and cooling at 114 to solvent receiver 85 in vessel 81. Bottoms from flash section 111 are passed through line 115 to the top of stripper 116 in vessel 112. Stripper 116 is equivalent (on the wax side) to stripper 11 in FIG. 1.

Thus it may be seen that, in the solvent dewaxing of oils and deoiling of waxes, both represented in FIG. 2, in the right hand side of FIG. 2 there has been reached two stripping vessels, respectively, vessels 93 and 116. The feed to stripper 93 is essentially wax free oil with solvent, while the feed to the top of stripper 116 is relatively oil free wax with solvent. The task in each case, with respect to the process of FIG. 1, previously described, is to remove the solvent from the wax free oil and oil free wax. Feed lines 92 and 115 to vessels 93 and 116, respectively, are equivalent to feed line 10 in FIG. 1 to stripper 11, in each case. The nitrogen feed lines 117 (to vessel 116) and 118 (to vessel 93) are both equivalent to the nitrogen feed line 12 to stripper 11 in FIG. 1. The product off lines include line 119 from the bottom of wax stripper 116, driven by pump 120, which passes deoiled wax, solvent free, after heat exchange at 109, out of the system via line 121. Bottoms from oil stripper 93 are taken off through line 122 to pump 123. The wax free oil is then passed out of the system through line 124 after cooling at 125. Lines 119 and 122 are each equivalent to line 13 in FIG. 1.

The overhead lines 125 and 126 from strippers 116 and 93, respectively, join in lines 127, are cooled at 128 and then go out of FIG. 2 in line 129. Line 127 is equivalent to line 14 of FIG. 1 going to knockout drum 15 and cooler 128 is equivalent to cooler 17*a* of FIG. 1 before drum 15.

In FIG. 1 lines 27 and 29 are equivalent to line 50 or a take off therefrom. Yet another advantage of the invention is that a steam powered solvent fractionator normally necessarily associated with surge tank 106 (in the old system a surge tank and water settler) may be omitted.

From the foregoing, it will be seen that this invention is one well adapted to attain all of the ends and objects hereinabove set forth together with other advantages which are obvious and which are inherent to the process.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown is the accompanying drawings is to interpreted as illustrative and not in a limiting sense.

We claim:

1. In a continuous process of solvent dewaxing of lubricating oil stocks, wherein a charge stock wax-bearing oil stream is first mixed with a solvent and, thereafter, a separation is made of this mixed stream into primary product streams of (a) substantially wax free oil and solvent, (b) substantially oil free wax and solvent and, sometimes, (c) slack wax and solvent, the solvent being thereafter separated from the said oil, wax and slack wax and recycled to the process for further mixing with said charge stock wax-bearing oil stream, the improvement in solvent separation from said primary product streams comprising:

continuously flowing one of said primary product streams to a stripping vessel, continuously flowing solvent free inert gas in counterflow contacting relationship with said primary product stream in said stripping vessel to strip solvent therefrom, removing substantially solvent free primary product from said stripping vessel as an end product, separately removing solvent rich inert gas from said stripping vessel, first compressing and thereafter condensing the said solvent rich inert gas, separating solvent from the inert gas after the compression and condensation thereof, passing the relatively solvent free inert gas to an absorber vessel, flowing a quantity of the charge stock wax-bearing oil stream which is being solvent dewaxed in counterflow contacting relationship with said inert gas in the absorber vessel to absorb substantially all of the remaining solvent therefrom, passing the substantially solvent free inert gas from the absorber vessel to the stripping vessel for stripping use in the latter, and passing the solvent containing charge stock oil to the dewaxing process.

2. A process as in claim 1, wherein the primary product stream is substantially oil free wax and solvent.

3. A process as in claim 1 wherein the primary product stream comprises substantially wax free oil and solvent.

4. A process as in claim 1 wherein the primary product stream comprises slack wax and solvent.

5. A process as in claim 1 wherein a cooling step is provided before compression of the solvent rich gas from the stripper vessel.

6. A process as in claim 1 including maintaining back pressure in the system from the passage of substantially solvent free gas from the absorber vessel.

7. A process as in claim 1 including the step of drying the solvent stripped gas after the absorption step and before recycle thereof to the stripping vessel.

8. In a continuous process of solvent dewaxing of lubricating oil stocks, wherein a charge stock wax-bearing oil stream is first mixed with a solvent and, thereafter, a separation is made of this mixed stream into primary product streams of (a) substantially wax free oil and solvent (b) substantially oil free wax and solvent and, sometimes, (c) slack wax and solvent, the solvent being thereafter separated from said oil, wax and slack wax and recycled to the process for further mixing with said charge stock wax-bearing oil stream, the improvement in solvent separation from at least of one of said primary product streams comprising:

continuously flowing one of said primary product stream to a stripping vessel, continuously flowing solvent free inert gas in counterflow contacting relationship with said primary product stream in said stripping vessel to strip solvent therefrom, removing substantially solvent free primary product from said stripping vessel as an end product, separately removing solvent rich inert gas from said stripping vessel, first compressing and thereafter condensing the said solvent rich inert gas, separating solvent from the inert gas after the compression and condensation thereof, passing the relatively solvent free inert gas to an absorption step wherein substantially the balance of the solvent in said inert gas is removed therefrom, and passing the substantially solvent free inert gas from the absorption step to the stripping vessel for stripping use therein.

9. A process as in claim 8 wherein the primary product stream comprises substantially oil free wax and solvent.

10. A process as in claim 8 wherein the primary product stream comprises substantally wax free oil and solvent.

11. A process as in claim 8 wherein the primary product stream comprises slack wax and solvent.

12. A process as in claim 8 wherein a cooling step is provided before compression of the solvent rich gas from the stripper vessel.

13. A process as in claim 8 including maintaining back pressure in the system from the passage of substantially solvent free gas from the absorption step.

14. A process as in claim 8 including the step of drying the solvent strip gas after the absorption step and before recycle thereof to the stripping vessel.

* * * * *